United States Patent [19]

Landa

[11] 4,439,035

[45] Mar. 27, 1984

[54] COPIER CLEANING SYSTEM INCORPORATING RESILIENT NONCELLULAR SEALING ROLLER

[75] Inventor: Benzion Landa, Edmonton, Canada

[73] Assignee: Savin Corporation, Stamford, Conn.

[21] Appl. No.: 958,977

[22] Filed: Nov. 9, 1978

[51] Int. Cl.[3] ..... G03G 21/00

[52] U.S. Cl. ..... 355/15; 15/256.52; 101/425

[58] Field of Search ..... 15/256.51, 256.52; 355/3 R, 15; 101/425; 118/652

[56] References Cited

U.S. PATENT DOCUMENTS

| | | | |
|---|---|---|---|
| 3,405,683 | 10/1968 | Jons et al. | 101/425 UX |
| 3,598,487 | 8/1971 | Mizuguchi | 355/15 |
| 3,807,853 | 4/1974 | Hudson | 355/15 |
| 3,871,081 | 3/1975 | Inoue et al. | 355/15 X |
| 3,884,572 | 5/1975 | Bacon et al. | 355/15 |
| 4,026,648 | 5/1977 | Takahashi | 355/15 |
| 4,032,229 | 6/1977 | Tani et al. | 355/15 |
| 4,056,315 | 11/1977 | Ariyama et al. | 355/15 X |
| 4,080,059 | 3/1978 | Tani et al. | 355/15 |
| 4,131,359 | 12/1978 | Honda | 355/15 |

FOREIGN PATENT DOCUMENTS

| | | | |
|---|---|---|---|
| 1454950 | 11/1976 | United Kingdom | 355/15 |

*Primary Examiner*—Fred L. Braun

*Attorney, Agent, or Firm*—Shenier & O'Connor

[57] ABSTRACT

At the cleaning station of a photocopier, a cleaning system including a wetted cleaning roller of resilient closed-cell material and a sealing roller of resilient noncellular material past which cleaning and sealing rollers the imaging surface is sequentially moved. The cleaning roller contacts the imaging surface and is so driven that its surface adjacent to the imaging surface moves in a direction opposite thereto to provide a scrubbing action. The sealing roller contacts the imaging surface and is so driven that its surface adjacent to the imaging surface moves in the same direction as and at the same speed as the imaging surface to provide a dynamic seal. Preferably, the sealing roller has a surface smoothness of between 2 and 10 microinches. The sealing roller may be formed by casting polyurethane in a glass tube to form an extremely smooth outer surface which provides a highly effective seal with the imaging surface against the flow of cleaning liquid. In a preferred embodiment, the sealing roller engages the cleaning roller so as to be cleaned of any adhering toner particles by the action of the cleaning roller.

7 Claims, 4 Drawing Figures

FIG. 1
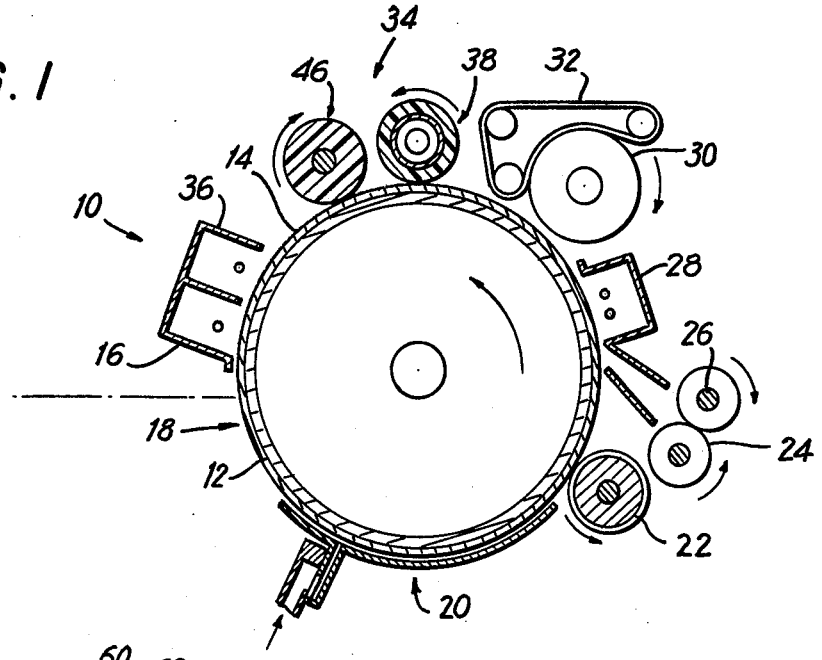
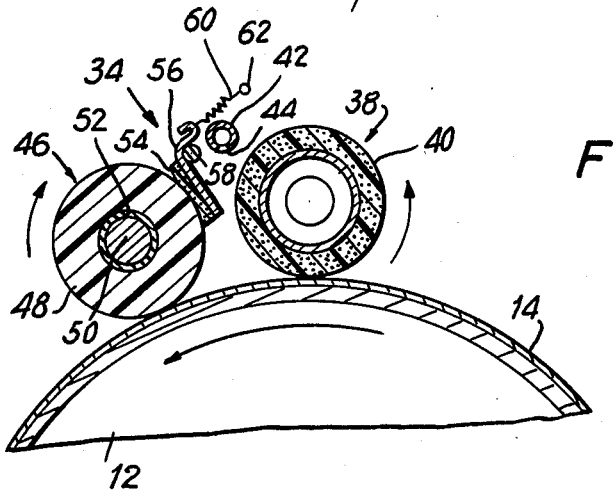
FIG. 2
FIG. 4
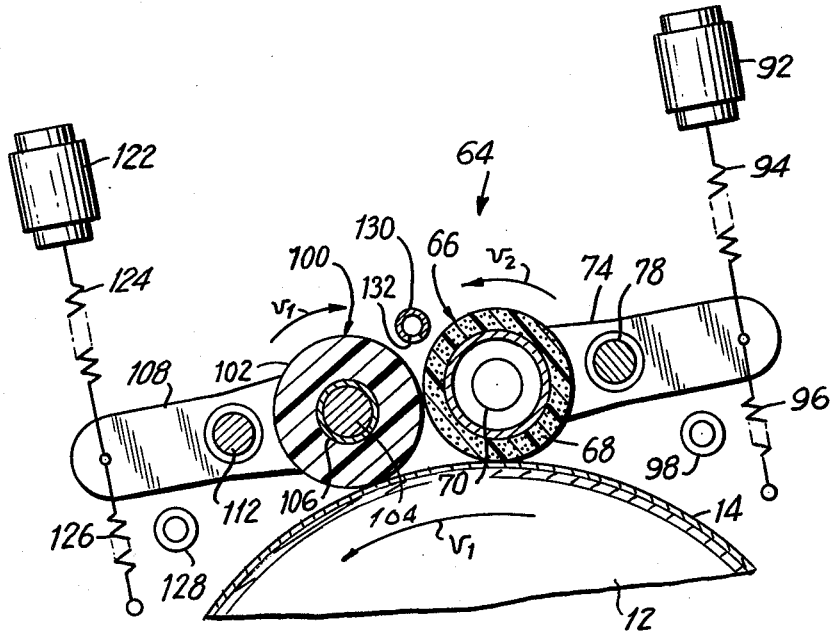

COPIER CLEANING SYSTEM INCORPORATING RESILIENT NONCELLULAR SEALING ROLLER

BACKGROUND OF THE INVENTION

This invention relates to apparatus for cleaning and drying and, in particular, to apparatus for cleaning and drying the photoconductive imaging surface of an electrophotographic copier.

Electrophotographic copiers of the image transfer type, or "plain paper" copiers, are well known in the art. In such copiers, an electrostatic image formed by selectively discharging a photoconductive surface is subjected to the action of a suitable developer to form a developed image corresponding to the latent image. The developed image thus formed is then transferred to a sheet of plain paper and the photoconductive surface theoretically is then available to be used for a subsequent copying operation. As a practical matter, however, the transfer of the developed image between the photoconductive surface and the sheet of plain paper is incomplete and the residual image which remains on the photoconductive surface must be removed before the next copying operation. Cleaning arrangements of the prior art typically employ a two-step operation in which the photoconductive surface is first moved past a wetted spongy roller of open-cell material which is so driven as to scrub residual toner particles from the surface which is then moved past an elongated squeegee blade which wipes the surface dry. While this and similar arrangements satisfactorily clean the photoconductive surface, the abrasion of the photoconductive surface due to the action of the roller and blade typically used eventually degrades the image-reproducing capability of the photoconductive surface. After a period of time in use, the open-cell cleaning roll accumulates a buildup of toner particles which increase its abrasiveness. In addition, buildup of toner on the blade increases the danger of damage to the photoconductive surface.

SUMMARY OF THE INVENTION

One of the objects of my invention is to provide an apparatus for cleaning and drying a surface which is especially suitable for use in an electrophotographic copier.

Another object of my invention is to provide a cleaning and drying apparatus which does not damage the imaging surface of an electrophotographic copier even after a long period of time in use of the machine.

A further object of my invention is to provide a cleaning and drying apparatus which is mechanically simple.

Other and further objects of my invention will be apparent from the following description.

In general, my invention contemplates an apparatus at the cleaning station of an electrophotographic copier in which the imaging surface is first subjected to the action of a cleaning liquid to clean the surface of residual toner particles and is then moved past a resilient noncellular sealing roller in rolling contact with the imaging surface to provide a dynamic seal, which prevents cleaning liquid from passing through the nip between the roller and imaging surface to direct the liquid off the sides of the imaging surface where it may be collected by a trough. Since the sealing squeegee roller moves at the same speed as the imaging surface and in the same direction at the nip, the roller does not abrade the imaging surface as do blades or the like of the prior art, thereby increasing the useful life of the imaging surface.

While any roller having a resilient, noncellular outer surface may be used as a squeegee roller in my cleaning system, I have found it especially advantageous to use a roller of the type described in my copending application Ser. No. 850,060, filed Nov. 9, 1977, comprising polyurethane cast in a glass tube. The surface of such a roller is not only extremely smooth (between 2 and 10 microinches), but is virtually free of micro-irregularities, permitting substantially continuous contact with the imaging surface.

In another aspect, my invention contemplates means for cleaning the sealing roller of toner particles or the like which have adhered to the squeegee roller. In the prior art cleaning rollers having spongy or pile coverings disposed in wiping engagement with the squeegee roller have been used to clean the latter. While these devices have operated more or less satisfactorily with squeegee rollers of the prior art, the abrasive character of their contact would, after only a few hours, degrade the extremely smooth surface of my relatively soft sealing or squeegee roller.

I have found that by using a wiper comprising a resilient material such as polyethylene, neoprene or other elastomer having a relatively flat contacting surface and having externally open or exposed, internally isolated or closed surface cells, I can effectively remove adhering particles from the squeegee roller without injuring its surface finish. In tests conducted using closed-cell polyethylene to wipe a polyurethane roller, no abrasion was detected even after 350 hours of operation. By way of contrast, the damage caused by other wiper materials, such as open-cell polyurethane foam, is significant after only a few tens of hours of operation. While no completely satisfactory explanation for the exceptionally low abrasiveness of the closed-cell material is yet known, it is believed that the surface tension in the exposed outer cells prevents the displacement of liquid from adjacent areas, thus maintaining an extremely thin film between the material and the roller surface. The only requirement is that the interface be maintained slightly wet. The wiper member may comprise either a static pad pressed against the squeegee roller or, if desired, a driven roller. Furthermore, the wiper member may be disposed in such a manner that it also contacts the imaging surface in advance of the squeegee roller, thus doubling as a cleaning member. Such a cleaning member also exhibits a low abrasiveness in the region of contact with the imaging surface, further reducing the long-term wear of that surface. Since the surface cells are isolated from the interior of the cleaning member, it does not soak up cleaning liquid as do open-celled polyurethane rollers and the like of the prior art, with their resulting clogging, increased abrasiveness and emission of fumes when the liquid eventually evaporates.

BRIEF DESCRIPTION OF THE DRAWINGS

In the accompanying drawings to which reference is made in the instant specification and in which like reference characters are used to indicate like parts in the various views:

FIG. 1 is a side elevation of an electrophotographic copier incorporating my cleaning system, with parts shown in section and with other parts removed.

FIG. 2 is an enlarged side elevation of the cleaning system of the copier shown in FIG. 1, with parts shown in section.

FIG. 4 is a section of the embodiment of my cleaning system shown in FIG. 3, taken along line 4—4 thereof.

DETAILED DESCRIPTION OF THE PREFERRED EMBODIMENTS

Figure 3:
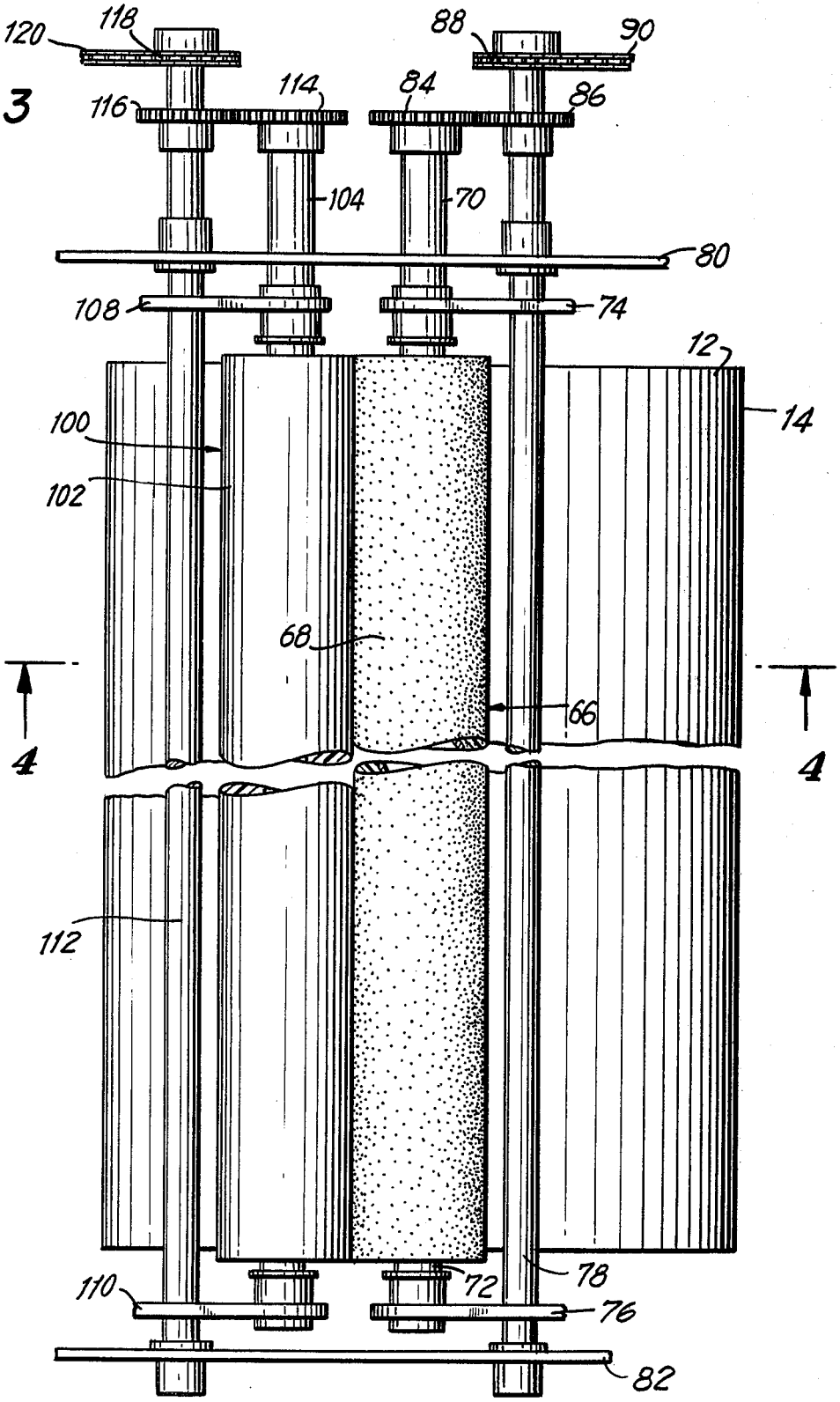
FIG. 3 is a top plan of an alternative embodiment of my cleaning system.

Referring now to FIGS. 1 and 2, an electrophotographic copier in which my apparatus may be used, indicated generally by the reference numeral 10, includes a cylindrical drum 12 having an outer surface 14 formed of a suitable photoconductor such as selenium. As is known to those skilled in the art, the selenium surface 14 is so formed as to have a highly polished appearance. In use of the copier 10, the surface 14 of the drum 12 is moved successively past a corona charger 16 which provides the surface 14 with a uniform electrostatic charge, an exposure station 18 at which the drum surface 14 is exposed to a light image of an original to selectively discharge the surface to form an electrostatic latent image, and a developing station 20 at which a liquid developer is applied to the drum surface to form a developed toner image. A metering roller 22 spaced slightly from the drum surface 14 immediately beyond the developing station 20 is rotated at a high speed in a reverse direction to remove excess developer liquid from the drum surface portion bearing the developed image.

Following the metering roller 22, the developed image is transferred to a sheet of plain copy paper (not shown) fed between a pair of rollers 24 and 26 to the surface 14 of the drum 12 beneath a transfer corona 28, which charges the copy paper with such a polarity as to attract the toner image electrostatically from the surface of the drum. The paper bearing the transferred image is then separated from the drum 12 by any suitable means (not shown) to pass between a turnaround roller 30 and a turnaround belt 32 trained around a portion of roller 30.

Finally, the drum surface passes through a cleaning station, indicated generally by the reference numeral 34, where the surface is cleaned of any remaining toner particles, and past a discharge corona 36, which dissipates any remaining electrostatic charge on the surface of the drum 12.

Referring now particularly to FIG. 2, the cleaning station 34 of the copier 10 includes a cleaning roller, indicated generally by the reference numeral 38, having a body 40 comprising a suitable resilient material such as an open-cell polyethylene foam or preferably a resilient material such as polyethylene or neoprene having externally open or exposed, internally closed or isolated surface cells. Such a surface is preferably provided by suitably cutting, grinding or otherwise shaping a resilient closed-cell material. Roller 38 is spring-biased against the surface 14 of the drum 12 by any suitable means (not shown) and is driven so as to move in a direction opposite to that of the drum 12 at their nip to provide a maximum scrubbing action for a given rotational velocity. I supply a suitable cleaning liquid to the roller 38 from a conduit or tube 42 disposed axially on the trailing side of the roller 38 and having orifices 44 formed along the bottom thereof.

The cleaning station 34 also comprises a sealing or squeegee roller, indicated generally by the reference numeral 46, having a noncellular polyurethane body 48 formed around a shaft 50 with a dielectric insulating layer 52 therebetween if desired. Squeegee roller 46 is spring-biased against the surface 14 of the drum 12 by any suitable means (not shown) and is rotated at a velocity equal to and in the same direction as the drum surface 14 at the nip therebetween. I mount an elongated wiper pad 54 in engagement with the surface of roller body 48. I form pad 54 of a resilient, preferably closed-cell material such as polyethylene or neoprene having exposed cells on the surface which are isolated from the interior thereof. Preferably, pad 54 has a tapering cross section as shown in FIG. 2, is about 15 to 20 millimeters wide and is from 2 to 5 millimeters thick at the thicker edge. I secure the wiper pad 54 to a metal backing strip 56 which in turn is secured to a pivot shaft 58. A spring 60 secured to a suitable post 62 biases the wiper pad 54 against the surface of the roller 46. Preferably, the position of the pivot center of the wiper pad 54 relative to its contact point with the roller 46 should be such that the rotation of the roller tends to move the wiper pad out of contact. Such a biasing arrangement is in effect self-releasing, minimizing damage to the roller surface if the system should run dry. Pad 54 serves to remove any toner particles which have adhered to the squeegee roller 46 and which may degrade the sealing action if allowed to remain on the roller.

I have found that a prime determinant of the sealing efficiency of the squeegee roller 46—that is, its ability to prevent cleaning liquid from passing through the nip formed with the drum surface 14—is the surface smoothness of the roller. The outer surface of the squeegee roller 46 should also be sufficiently resilient that the roller forms a nip with the imaging surface 14 of appreciable circumferential extent, as well as conforming to any micro-irregularities, such as residual toner particles missed by the cleaning roller 38, which may be present on the drum surface 14. Preferably, therefore, the roller 46 should have an outer surface hardness in the range of 10 to 80 Shore and have a fine surface finish which is not more than 50 microinches. Suitably, the surface finish should be better than 10 microinches and preferably of at most 6 microinches.

An acceptable squeegee roller for a system in accordance with this invention can be obtained by casting a settable resilient compound in a precision drawn tube and this gives rise to a surface finish on the cast roller, after removal from the tube, which can easily be made better than 50 microinches. Preferably, however, the tube in which the material is cast to form the roller has been honed to a surface finish of between 4 and 8 microinches so that the resultant cast roller has a surface finish which is better than 10 microinches. A typical roller formed by this method, having a surface finish of 6 microinches and a hardness of 25 Shore, is described more fully in British Pat. No. 1,450,396, published Sept. 22, 1976.

I have found that a further dramatic improvement in performance may be obtained if the squeegee roller 46 is formed of polyurethane cast in a glass tube as described more fully in my copending application Ser. No. 850,060, filed Nov. 9, 1977. According to the method disclosed in my application, the interior of the glass tube used as the mold is first coated with a suitable release agent, such as a 1% (by weight) solution of carnauba wax in trichloroethylene, preferably by dipping it into the solution. Next, the roller shaft is positioned coaxially inside the mold, and polyurethane formed by mixing suitable reagents at a temperature of approximately 130° F. is poured into the remaining annular region. The polyurethane is then cured by placing the mold for about 4 hours in an oven heated to about 265° F., the exact time and temperature depending on the choice of reagents. Finally, after the mold has cooled to room temperature, a solvent is poured into the mold to dissolve the release agent, allowing the finished roller to be easily removed.

Referring now to FIGS. 3 and 4, in a preferred alternative embodiment of my cleaning apparatus, the stationary wiper pad is removed and the sealing or squeegee roller is disposed in contact with both the drum surface 14 and the cleaning roller so that the latter roller also cleans the surface of the squeegee roller. More specifically, my alternative embodiment, indicated generally by the reference numeral 64, includes a cleaning roller, indicated generally by the reference numeral 66, having a body 68 formed from a resilient, preferably closed-cell material such as polyethylene or neoprene having cells open at the surface and isolated from the interior of the body. Stub shafts 70 and 72 at the opposite ends of roller 66 are rotatably received by corresponding ends of respective pivot arms 74 and 76. A pivot shaft 78 rotatably receives the pivot arms 74 and 76. Stub shaft 70 and the adjacent portion of pivot shaft 78 receive respective intermeshing gears 84 and 86. Shaft 78 also receives a sprocket wheel 88 coupled by a drive chain 90 to any suitable drive means (not shown) rotating in synchronism with the drum 12. A solenoid 92 the armature of which is connected to one end of pivot arm 74 by a spring 94 is actuated when the copier 10 is in use to urge the roller 66 resiliently against the surface 14 of the drum 12. When the copier 10 is not in use, solenoid 92 is deactuated to permit a retraction spring 96 to pull the roller 66 away from the drum 12 to a position defined by a limit stop 98. Roller 66 is disengaged from the drum surface 14 during these quiescent periods to prevent sticking which might otherwise occur.

The sealing roller of my alternative embodiment, indicated generally by the reference numeral 100, is similar to the roller 46 shown in FIG. 2 and comprises a resilient noncellular body 102 of polyurethane or the like formed around a shaft 104 with an optional dielectric insulating layer 106 therebetween. Shaft 104 is received by respective pivot arms 108 and 110. A pivot shaft 112 rotatably received by frame portions 80 and 82 in turn rotatably receives pivot arms 108 and 110. Pivot shaft 112 and roller 104 carry respective intermeshing gears 114 and 116. A sprocket wheel 118 carried by pivot shaft 112 is coupled by a drive chain 120 to a suitable driving source (not shown) in synchronism with the drum 12. I have found it preferable to drive the squeegee roller 100 or 46 independently of the drum surface 14, owing to the extremely low friction between smooth roller surface and the surface of drum 12. A solenoid 122 coupled to pivot arm 108 through a spring 124 is actuated while the copier 10 is in use to bias the squeegee roller 100 into engagement with the surface 14 of the drum 12. When the copier 10 is not in use, a retraction spring 126 retracts the roller 100 to a limit position defined by a suitable stop 128.

A conduit 130 disposed above rollers 64 and 98 and parallel thereto supplies cleaning liquid to roller 66 from orifices 132 spaced along the length of the conduit 130. Rotation of the cleaning roller 66 carries the cleaning liquid first through the nip formed with the squeegee roller 100 and then through the nip formed with the drum surface 14, providing a nonabrasive cleaning action at both locations. Dry contact may be avoided when the system is first actuated either by directly irrigating the nip areas in advance of mechanical actuation or, where a liquid developer is used, by delaying engagement of the rollers 66 and 100 until the drum surface portion initially at the developing station 20 has advanced to the cleaning station 64. To ensure adequate scrubbing of the squeegee roller 100 by the cleaning roller 66, the surface velocity $v_2$ of the cleaning roller 66 should be greater than, preferably twice as much as, the surface velocity $v_1$ of the squeegee roller 100 and the drum surface 14.

It will be seen that I have accomplished the objects of my invention. My cleaning system is especially suitable for use in an electrophotographic copier and does not damage the imaging surface even after a long period of time. My cleaning system is mechanically simple.

It will be understood that certain features and subcombinations are of utility and may be employed without reference to other features and subcombinations. This is contemplated by and is within the scope of my claims. It is further obvious that various changes may be made in details within the scope of my claims without departing from the spirit of my invention. It is, therefore, to be understood that my invention is not to be limited to the specific details shown and described.

Having thus described my invention, what I claim is:

1. In an electrophotographic copier in which an imaging surface is moved to an imaging station at which said surface is provided with an electrostatic latent image of an original, to a developing station at which a developer is applied to said surface to form a developed image, to a transfer station at which said developed image is transferred to a copy sheet, and then to a cleaning station, apparatus at said cleaning station including a cleaning roller having a body of resilient material formed with cells over the surface of said roller which are open to the external environment and isolated from the interior of said body, means for wetting the surface of said body with cleaning liquid, means for effecting relative scrubbing engagement between said imaging surface and the surface of said body, a polyurethane squeegee roller having a surface smoothness of between 2 and 10 microinches positioned in engagement with said imaging surface and said cleaning roller at a point following said cleaning roller, and means for rotating said squeegee roller so that the relative motion between its surface and said imaging surface is substantially zero, whereby said squeegee roller forms a dynamic seal with said imaging surface.

2. In an electrophotographic copier in which an imaging surface is moved to an imaging station at which said surface is provided with an electrostatic latent image of an original, to a developing station at which a developer is applied to said surface to form a developed image, to a transfer station at which said developed image is transferred to a copy sheet, and then to a cleaning station, apparatus at said cleaning station including means for subjecting said surface to the action of a cleaning liquid to clean said surface, a squeegee roller having a surface smoothness of between 2 and 10 microinches, means for urging said roller into contact with said imaging surface at a point following said cleaning means, means for rotating said squeegee roller so that the relative motion between its surface and said imaging surface is substantially zero, whereby said squeegee roller forms a dynamic seal with said imaging surface, a wiper member having a body of resilient material formed with cells over the surface of said member which are open to the external environment and isolated from the interior of said body, and means for mounting said member with the surface of said body engaging said roller at a point remote from said imaging surface.

3. In an electrophotographic copier in which an imaging surface is moved to an imaging station at which said surface is provided with an electrostatic latent image of an original, to a developing station at which a developer is applied to said surface to form a developed image, to a transfer station at which said developed image is transferred to a copy sheet, and then to a cleaning station, apparatus at said cleaning station including a cleaning roller having a body of resilient material formed with cells over the surface of said roller which are open to the external environment and isolated from the interior of said body, means for wetting the surface of said body with cleaning liquid, means for effecting relative scrubbing engagement between said imaging surface and the surface of said body, a squeegee roller having a resilient noncellular outer surface, means for disposing said squeegee roller in engagement with said imaging surface and said cleaning roller at a point following said cleaning roller, and means for rotating said squeegee roller so that the relative motion between its surface and said imaging surface is substantially zero, whereby said squeegee roller forms a dynamic seal with said imaging surface.

4. In an electrophotographic copier in which an imaging surface is moved to an imaging station at which said surface is provided with an electrostatic latent image of an original, to a developing station at which a developer is applied to said surface to form a developed image, to a transfer station at which said developed image is transferred to a copy sheet, and then to a cleaning station, apparatus at said cleaning station including means for subjecting said surface to the action of a cleaning liquid to clean said surface, a squeegee roller having a resilient noncellular outer surface, means for urging said roller into contact with said imaging surface at a point following said cleaning means, means for rotating said squeegee roller so that the relative motion between its surface and said imaging surface is substantially zero, whereby said squeegee roller forms a dynamic seal with said imaging surface, a wiper member having a body of resilient material formed with cells over the surface of said member which are open to the external environment and isolated from the interior of said body, and means for mounting said member with the surface of said body biased into engagement with said roller at a point remote from said imaging surface and in a direction having a component opposite to the motion of said squeegee roller.

5. In an electrophotographic copier in which an imaging surface is moved to an imaging station at which said surface is provided with an electrostatic latent image of an original, to a developing station at which a developer is applied to said surface to form a developed image, to a transfer station at which said developed image is transferred to a copy sheet, and then to a cleaning station, apparatus at said cleaning station including means for subjecting said surface to the action of a cleaning liquid to clean said surface, a squeegee roller having a resilient noncellular outer surface, means for urging said roller into contact with said imaging surface at a point following said cleaning means, means for rotating said squeegee roller so that the relative motion between its surface and said imaging surface is substantially zero, whereby said squeegee roller forms a dynamic seal with said imaging surface, a wiper member having a body of resilient material formed with cells over the surface of said member which are open to the external environment and isolated from the interior of said body, and means for mounting said member with the surface of said body biased into engagement with said roller at a point remote from said imaging surface.

6. In an electrophotographic copier in which an imaging surface is moved to an imaging station at which said surface is provided with an electrostatic latent image of an original, to a developing station at which a developer is applied to said surface to form a developed image, to a transfer station at which said developed image is transferred to a copy sheet, and then to a cleaning station, apparatus at said cleaning station including means for subjecting said surface to the action of a cleaning liquid to clean said surface, a squeegee roller having a resilient noncellular outer surface, means for urging said roller into contact with said imaging surface at a point following said cleaning means, means for rotating said squeegee roller so that the relative motion between its surface and said imaging surface is substantially zero, whereby said squeegee roller forms a dynamic seal with said imaging surface, a wiper member having a body of resilient material formed with cells over the surface of said member which are open to the external environment and isolated from the interior of said body, and means for mounting said member with the surface of said body engaging said roller at a point remote from said imaging surface.

7. Apparatus for removing excess liquid from a moving imaging surface of an electrophotographic copier including in combination a polyurethane squeegee roller having a surface smoothness of less than 10 microinches, means for urging said squeegee roller into contact with said imaging surface, means for rotating said squeegee roller so that the relative motion between its surface and said imaging surface is subtantially zero, whereby said squeegee roller forms a dynamic seal with said imaging surface, a wiper member having a body of resilient material formed with cells over the surface of said member which are open to the external environment and isolated from the interior of said body and means for mounting said member with the surface of said body engaging said roller at a point remote from said imaging surface.

* * * * *